US006860033B2

(12) United States Patent
Lätti et al.

(10) Patent No.: US 6,860,033 B2
(45) Date of Patent: Mar. 1, 2005

(54) METHOD FOR MINIMIZING TENSION VARIATION IN A PAPER WEB INDUCED BY DRYING OF THE WEB IN A PAPER MACHINE

(75) Inventors: Hannu Lätti, Järvenpää (FI); Antti Heikkinen, Helsinki (FI); Heikki Kettunen, Espoo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/381,489

(22) PCT Filed: Oct. 1, 2001

(86) PCT No.: PCT/FI01/00855

§ 371 (c)(1),
(2), (4) Date: Aug. 6, 2003

(87) PCT Pub. No.: WO02/29156

PCT Pub. Date: Apr. 11, 2002

(65) Prior Publication Data

US 2004/0050518 A1 Mar. 18, 2004

(30) Foreign Application Priority Data

Sep. 29, 2000 (FI) ..... 20002162

(51) Int. Cl.[7] ..... F26B 3/00; D21F 11/00; D21J 1/06

(52) U.S. Cl. ..... 34/446; 162/198; 162/204; 162/DIG. 6

(58) Field of Search ..... 34/114, 115, 116, 34/117, 445, 446, 483, 123; 162/109, 111, 117, 198, 204, DIG. 6, 253, 263

(56) References Cited

U.S. PATENT DOCUMENTS

| | | | | |
|---|---|---|---|---|
| 3,864,842 A | * | 2/1975 | Sawyer | 34/446 |
| 4,162,563 A | | 7/1979 | Lawrence et al. | |
| 4,920,621 A | | 5/1990 | Metzen | |
| 5,298,121 A | | 3/1994 | Kilmister | |
| 5,649,448 A | | 7/1997 | Koskimies et al. | |

FOREIGN PATENT DOCUMENTS

| | | |
|---|---|---|
| GB | 794012 | 4/1958 |
| WO | WO 01/00924 | 1/2001 |
| WO | WO 02/29156 | 4/2002 |

OTHER PUBLICATIONS

International Search Report issued in International Patent Application No. PCT/FI01/00855.
International Preliminary Examination Report issued in International Patent Application No. PCT/FI01/00855.
Jentzen, C.A., the Effect of Stress Applied During Drying on Some of the Properties of Individual Pulp Fibers. Tappi 47 (1964) 7, s. 412–418.
Nanko, H., Asano, S. & Ohsawa, J., Shrinking Behavior of Pulp Fibers During Drying. Papers presented at 1991 International Paper Physics Conference. Kona, Hawaii, Sep. 22–26, 1991. TAPPI Press, Atlanta, 1991. Book 2, s. 365–373.
Hrun, M., The Influence of Drying Strategies on the Mechanical Properties of Paper. Doctoral thesis, Royal Inst. Technol., Stockholm 1980, 31 s.
Page, D.H. & Tydeman, P.A., Physical Processes Occurring During the Drying Phase. Transactions of the symposium held at Cambridge, Sep. 1965, vol. 1, Ed. F. Bolam, Tech. Sect. Br. Pap. Board Makers' Assoc., London, 1966, s. 371–396.
Giertz, H.W. & Rødland, G., Elongation of Segments—Bonds in the Secondary Regime of the Load/Elongation Curve. Tappi 1979 International Paper Physics Conference. British Columbia, Sep. 17–19, 1979. Tech. Sect. Can. Pulp Pap. Assoc., Montreal, 1979, s. 129–136.
Schulz, J.H., The Effect of Straining During Drying on the Mechanical and Viscoelastic Behavior of Paper. Tappi, 44 (1961) 10, s. 736–744.
Berthold, J., Water Adsorption and Uptake in the Fibre Cell Wall as Affected by Polar Groups and Structure. Doctoral thesis, Royal Inst. Technol., Stockholm 1996, 41s.
Laivins, G.V. & Scallan, A.M., the Mechanism of Hornification of Wood Pulps. Products of Papermaking. Transactions of the tenth fundamental research symposium held at Oxford, Sep. 1993. vol. 2., Ed. C.F. Baker, Pira International, Surrey 1993, s. 1235–1260.
Maloney, Thad C., ACTA Polytechnica Scandinavica, Chemical Technology Series No. 275. On the Pore Structure and Dewatering Properties of the Pulp Fiber Cell Wall.

* cited by examiner

*Primary Examiner*—Kenneth Rinehart
(74) *Attorney, Agent, or Firm*—Stiennon & Stiennon

(57) ABSTRACT

Tension variations in the paper web on a paper machine are caused by successive draws and moisture fluctuations. Good strength properties require optimization of the draws. In addition, the tension variation induced by moisture must be minimized. The analysis of local modulus and the strain components can be used for determining optimal locations for profiling actuators in order to achieve good tension profile. Longitudinal strain components of the web, i.e. reversible elastic strain, permanent plastic strain and frozen-in strain relievable with water are continuously measured and determined and the variation of said longitudinal components is minimized by correcting the moisture content of the paper web in a dryer section of the paper machine and/or by optimizing the draws between dryer groups in the dryer section.

7 Claims, No Drawings

METHOD FOR MINIMIZING TENSION VARIATION IN A PAPER WEB INDUCED BY DRYING OF THE WEB IN A PAPER MACHINE

CROSS REFERENCES TO RELATED APPLICATIONS

This application is a U.S. national stage application of International Application No. PCT/FI01/00855, filed Oct. 1, 2001, and claims priority on Finnish Application No. 20002162, filed Sep. 29, 2000, the disclosure of each application being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to drying-induced tension variation in a paper web. More specifically, the invention relates to a method for minimizing tension variation in a paper web induced by drying of the web in a paper machine.

On-machine coating and calendering processes integrated into a paper machine have set tight constraints on tension variation in the paper web. A single weak spot in the paper web simultaneously with a tension surge can destroy the performance of the whole papermaking line. In addition, a process integrated into the machine does not include any dampening stage typical of conventional off-machine finishing processes taking place apart from the machine. In a machine roll, moisture and temperature variations can even out. Also, local stress concentrations are reduced during a long stress relaxation period.

The recent development of the wet press and dryer sections of the paper machine allows a higher web speed. The runnability of the paper machine is improved by closing all open draws and by using other new components. Due to this development, control of dryer section parameters has brought new potential. The magnitude of wet and dry straining levels can be varied widely.

The objective of this paper is to examine how moisture variation and several successive draws affect the theological properties of paper during the manufacturing process. At present, tension profile is the most important available on-line measurement technique for evaluating the theological properties of the paper web. Thus, special emphasis has been placed on understanding the significance of development of cross-direction tension profiles in a dry paper web.

In the literature, one can find several studies on the development of fiber morphology and on the rheological properties of paper during drying. See: [1] Jentzen, C. A., The effect of stress applied during drying on some of the properties of individual pulp fibers. Tappi 47 (1964) 7, s. 412–418. [2] Nanko, H., Asano, S. & Ohsawa, J., Shrinking behavior of pulp fibers during drying. Papers presented at 1991 International Paper Physics Conference. Kona, Hawaii, Sep. 22–26, 1991. TAPPI Press, Atlanta, 1991. Book 2, s. 365–373. [3] Htun, M., The influence of drying strategies on the mechanical properties of paper. Doctoral thesis, Royal Inst. Technol., Stockholm 1980, 31 s. [4] Page, D. H. & Tydeman, P. A., Physical processes occurring during the drying phase. Transactions of the symposium held at Cambridge, September 1965, Vol. 1, Ed. F. Bolam, Tech. Sect. Br. Pap. Board Makers' Assoc., London, 1966, s. 371–396. [5] Giertz, H. W. & Rodland, G., Elongation of segments—bonds in the secondary regime of the load/elongation curve. Tappi 1979 International paper physics conference. British Columbia, Sep. 17–19, 1979. Tech. Sect. Can. Pulp Pap. Assoc., Montreal, 1979, s. 129–136. [6] Schulz, J. H., The Effect of Straining During Drying on the Mechanical and Viscoelastic Behavior of Paper. Tappi, 44 (1961) 10, s. 736–744.

Most studies have compared free drying, restraint drying and wet straining. Also, the effect of removal of different water fractions from fibers on shrinkage, hornification, wrinkling etc. is well established. See: [7] Weise, U., Characterization and mechanism of changes in wood pulp fibres caused by water removal. Doctoral thesis, Helsinki University of Technology, Department of forest products, Espoo 1997, 141 s. [8] Berthold, J., Water adsorption and uptake in the fibre cell wall as affected by polar groups and structure. Doctoral thesis, Royal Inst. Technol., Stockholm 1996, 41s. [9] Laivins, G. V. & Scallan, A. M., The mechanism of hornification of wood pulps. Products of papermaking, Transactions of the tenth fundamental research symposium held at Oxford, September 1993, Vol. 2., Ed. C. F. Baker, Pira International, Surrey 1993, s. 1235–1260. [10] Maloney.

It is well known that the elastic modulus of dry paper increases by the action of wet straining, while breaking strain decreases at the same time.

SUMMARY OF THE INVENTION

The present invention relates to a method for minimizing tension variation in a paper web induced by drying of the web in a paper machine. Tension variations in the paper web are caused by successive draws and moisture fluctuations. Good strength properties require optimization of the draws. In addition, the tension variation induced by moisture must be minimized. The analysis of local modulus and the strain components can be used for determining optimal locations for profiling actuators in order to achieve good tension profile. In the method according to the invention, longitudinal strain components of the web, i.e. reversible elastic strain, permanent plastic strain and frozen-in strain relievable with water are continuously measured and determined and the variation of said longitudinal components is minimized by correcting the moisture content of the paper web in a dryer section of the paper machine and/or by optimizing the draws between dryer groups in the dryer section.

BRIEF DESCRIPTION OF THE DRAWINGS

Not applicable.

DESCRIPTION OF THE PREFERRED EMBODIMENTS

In this study, samples with different initial solids content were subjected to several straining cycles in an ordinary tensile testing machine during drying. Thus, a more paper-machine-like drying process was obtained than in ordinary laboratory tests. Pilot machine trial runs were also performed to compare the results. In addition, water was applied to dry paper in order to find out the effect of drying history on dimensional stability.

The tension profile in the paper machine is a combined effect of the local stiffness properties and the local strain in paper. Stiffness can be characterized by local elastic modulus and, perhaps, by local relaxation. Local strain can be divided into three strain components that affect the tension profile of dry paper. Elastic strain recovers when drying or external stress is relieved. Plastic strain is permanent and probably caused by sliding of fibers in wet paper and by other permanent deformations in fiber wall structure. The third component, frozen-in strain, is relieved when dry paper is rewetted.

In restraint drying, initial moisture variation in wet sheet does not induce differences in the elastic modulus or strain properties of paper. This means that the changes in the rheological properties of a paper web are caused by the combined effect of moisture variation and straining. The local modulus and the relative properties of the three strain components depend on the solids content at which the straining sequences occur. Thus, the initial moisture variation induces different local drying histories. In the paper machine this effect is even amplified, because the moisture variation increases during the drying process.

It has been shown that tension variation is brought about by successive draws and moisture fluctuations. The amplitude of draws causes the final tension difference between two samples with different initial solids contents. In our samples, a 3% initial moisture difference in the press section induced a variation of up to 30% in tension.

Good strength properties require optimization of draws. In addition, the tension variation induced by moisture must be minimized. Analysis of local modulus and strain components can be used for determining optimal locations for profiling actuators in order to achieve a good tension profile.

As is already clear from the above description, an object of the present invention is to achieve minimal web tension variations. A further object is to achieve as even a distribution of longitudinal components as possible in the web. With a view to achieving these objects as well as those coming out later, the invention is mainly characterized in that longitudinal strain components of the web, i.e. reversible elastic strain, permanent plastic strain and frozen-in strain relievable with water are continuously measured and determined in the method and the variation of said longitudinal components is minimized by correcting the moisture content of the paper web in a dryer section of a paper machine and/or by optimizing the draws between dryer groups in the dryer section.

The mechanisms causing tension variations have been described above. Thus, the new papermaking concept in accordance with the invention is mainly based on the following things:

First of all, in the examination, by web tension is meant the product of the tensile strength and the elastic strain of the web, i.e. web tension=tensile strength*elastic strain.

The draws of the web during drying in the dryer section do not cause any substantial variation in the elastic modulus of dry paper. Thus, minimal web tension variation is achieved when the variation of the longitudinal components of paper have been minimized.

The longitudinal components of paper in turn refer to elastic strain, plastic strain and frozen-in strain which is relieved with water.

For adjustments, the longitudinal components of paper need to be measured. They are measured as follows:

Elastic strain=web tension/elastic modulus (Iqtension/STFI). Measurement of tension is carried out at the end of the dryer section of the paper machine at a location where the conditions of tension measurement do not change.

Plastic strain=total strain—elastic strain. Total strain is determined as an image analysis from a drying cylinder.

The frozen-in strain relievable with water is based on plastic strain and on a laboratory calibration curve in which the amount of the shrinkage potential of pulp and the amount of the frozen-in strain produced by different draw levels have been measured.

The profiles of elastic strain and plastic strain determine the tension variation in a dry web. The frozen-in strain profile affects the tension variations in the web in connection with rewetting. Rewetting occurs, among other things, in surface sizing, coating and calendering.

As known, the dry solids content of the web increases in the dryer section of the paper machine in the running direction of the web, i.e. when the web moves forward in the dryer section. In the dryer section, attempts are made to keep the draws between dryer groups as short as possible. However, at the beginning of the dryer section where the dry solids content is lowest and, on the other hand, at the end of the dryer section where the dry solids content is highest, the draws between the dryer groups are not the most critical from the point of view of tension variations. At a dry solids content of below 60% (in the beginning of the dryer section), local moisture faults in the web do not cause any significant profile errors when the web is subjected to draws. The paper is drawn to a sufficient extent to achieve the tensile strength/elastic modulus of the paper.

In an attempt to achieve minimal tension variation and as uniform a distribution of the longitudinal components as possible in the web these properties can be affected in a number of ways in accordance with the invention. In the method in accordance with the invention, the primary mode of operation used is that actuators correcting the moisture content of the web are arranged in the area of the beginning of the dryer section where the dry solids content of the web is below 60%. These actuators can be drying and/or moisturizing actuators, which provide drying/moisturizing profiling, respectively. Impingement devices, water atomizing/spraying devices and equivalent can be mentioned as examples of drying/moisturizing actuators. The moisture-correcting actuators are controlled by measurement of the moisture content of the web. The moisture content measurement is carried out most advantageously in the dryer section in the area where the dry solids content of the web is in a range of 75 to 85%. This area is the area with the highest moisture variation and, when measurement is accomplished in this area, the resolution of measurement is the best possible.

The variation of longitudinal components caused by the local moisture faults of the web when it is subjected to draws is highest in the area of the dryer section where the dry solids content of the web is in a range of 60 to 85%. For this reason, in the method in accordance with the invention, the draws are minimized in this area. In addition, there is reason to use, for example, impingement units in this area because they can provide conditions corresponding to restraint drying (minimum draw).

The profile of the frozen-in strain relievable with water can be influenced to some extent by the draws of the dryer section. The effect of draws on the web and on the frozen-in strain relievable with water is at a dry solids content of 55 to 65% opposite to that of a dry solids content of 75 to 85%. Because of this characteristic, in accordance with the invention, it is possible to make the draws to influence in a desired direction at different locations of the dryer section. This longitudinal component profile can also be affected by using a moisturizing actuator when the dry solids content of the web is from 55 to 65%.

By way of summary of the invention, it may be stated that with a view to minimizing tension variation in a paper web induced by drying of the web, longitudinal strain components of the web, i.e. reversible elastic strain, permanent plastic strain and frozen-in strain relieved with water are continuously measured and determined in the method and the variation of said longitudinal components is minimized by correcting the moisture content of the paper web in the dryer section of the paper machine and/or by optimizing the draws between dryer groups in the dryer section.

The moisture content of the paper web is advantageously affected in the area of the beginning of the dryer section, when the dry solids content of the web is below 60%, by means of actuators which correct the moisture content of the web and by which the web is moisturized and/or dried, and the operation of said moisture-correcting actuators is controlled by measuring the moisture content of the web in the dryer section in the running direction of the web after the moisture-correcting actuators. The moisture content of the web is measured in the dryer section preferably in the area where the dry solids content of the web is in a range of 75 to 85%.

In order to minimize the variation of the longitudinal strain components of the web caused by local moisture faults of the paper web when it is subjected to draws, the draws are most advantageously minimized in the dryer section in the area where the dry solids content of the web is in a range of 60 to 85%.

To affect the profile of the water-relievable frozen-in strain of the paper web in one direction, the web is subjected to a draw or draws in the area of the dryer section where the dry solids content of the web is in a range of 55 to 65% or, in a corresponding way, in the opposite direction, in the area where the dry solids content of the web is in a range of 75 to 85%. To affect the profile of the frozen-in strain relievable with water, it is also possible to use an actuator that moisturizes the web in the area of the dryer section where the dry solids content of the web is in a range of 55 to 65%.

To measure the elastic strain of the paper web, the tension of the web is measured in the end area of the dryer section. To measure plastic strain, the total strain of the web is determined as an image analysis from a drying cylinder of the dryer section. The water-relieved frozen-in strain of the paper web is determined based on plastic strain and a laboratory curve, which laboratory curve shows the measured shrinkage potential of pulp and the measured amount of the frozen-in strain caused by different draw levels.

The different embodiments of the invention may vary within the inventive idea defined in the accompanying claims.

What is claimed is:

1. A method for minimizing tension variation in a paper web induced by drying of the web in a paper machine having a dryer section with dryer groups and draws between said dryer groups, the method comprising the steps of:

measuring and determining longitudinal strain components of the web, including reversible elastic strain, permanent plastic strain and frozen-in strain relievable with water; and minimizing variation of said longitudinal strain components by correcting the moisture content of the paper web in the dryer section of the paper machine and/or by optimizing the draws between dryer groups in the dryer section, wherein in an area of the beginning of the dryer section, when the dry solids content of the web is below 60 percent, the moisture content of the paper web is affected by means of actuators which correct the moisture content of the web and by which the web is moisturized and/or dried, and that the operation of said moisture-correcting actuators is controlled by measuring the moisture content of the web in the dryer section in the running direction of the web after the moisture-correcting actuators.

2. The method of claim 1, wherein the moisture content of the web is measured in the dryer section in the area where the dry solids content of the web is in a range of 75 percent to 85 percent.

3. The method of claim 1, wherein in order to minimize the variation of the longitudinal strain components of the web caused by local moisture faults of the paper web when it is subjected to draws, the draws are minimized in the dryer section in the area where the dry solids content of the web is in a range of 60 percent to 85 percent.

4. A method for minimizing tension variation in a paper web induced by drying of the web in a paper machine having a dryer section with dryer groups and draws between said dryer groups, the method comprising the steps of:

measuring and determining longitudinal strain components of the web, including reversible elastic strain, permanent plastic strain and frozen-in strain relievable with water; and minimizing variation of said longitudinal strain components by correcting the moisture content of the paper web in the dryer section of the paper machine and/or by optimizing the draws between dryer groups in the dryer section, wherein in order to affect the profile of the water-relievable frozen-in strain of the paper web in one direction, the web is subjected to a draw or draws in the area of the dryer section where the dry solids content of the web is in a range of 55 percent to 65 percent or, in a corresponding way, in the opposite direction, in the area where the dry solids content of the web is in a range of 75 percent to 85 percent.

5. A method for minimizing tension variation in a paper web induced by drying of the web in a paper machine having a dryer section with dryer groups and draws between said dryer groups, the method comprising the steps of:

measuring and determining longitudinal strain components of the web, including reversible elastic strain, permanent plastic strain and frozen-in strain relievable with water; and minimizing variation of said longitudinal swain components by correcting the moisture content of the paper web in the dryer section of the paper machine and/or by optimizing the draws between dryer groups in the dryer section, wherein in order to affect the profile of the water-relievable frozen-in strain of the paper web, an actuator that moisturizes the web is used in the area of the dryer section where the dry solids content of the web is in a range of 55 percent to 65 percent.

6. A method for minimizing tension variation in a paper web induced by drying of the web in a paper machine having a dryer section with dryer groups and draws between said dryer groups, the method comprising the steps of:

measuring and determining longitudinal strain components of the web, including reversible elastic strain, permanent plastic strain and frozen-in strain relievable with water; and minimizing variation of said longitudinal strain components by correcting the moisture content of the paper web in the dryer section of the paper machine and/or by optimizing the draws between dryer groups in the dryer section, wherein in order to measure the plastic strain of the paper web, the total strain of the web is determined as an image analysis from a drying cylinder of the dryer section.

7. A method for minimizing tension variation in a paper web induced by drying of the web in a paper machine having a dryer section with dryer groups and draws between said dryer groups, the method comprising the steps of:

measuring and determining longitudinal strain components of the web, including reversible elastic strain, permanent plastic strain and frozen-in strain relievable with water; and minimizing variation of said longitudinal strain components by correcting the moisture content of the paper web in the dryer section of the paper machine and/or by optimizing the draws between dryer groups in the dryer section, wherein the water-relievable frozen-in strain of the paper web is determined based on plastic strain and a laboratory curve, which laboratory curve shows the measured shrinkage potential of pulp and the measured amount of the frozen-in strain caused by different draw levels.

* * * * *